US011350198B2

(12) United States Patent
Kamimura

(10) Patent No.: US 11,350,198 B2
(45) Date of Patent: May 31, 2022

(54) EARPHONE AND SUPPORTER THEREOF

(71) Applicant: JVCKENWOOD CORPORATION, Yokohama (JP)

(72) Inventor: Shinji Kamimura, Yokohama (JP)

(73) Assignee: JVCKENWOOD CORPORATION, Yokohama (JP)

( * ) Notice: Subject to any disclaimer, the term of this patent is extended or adjusted under 35 U.S.C. 154(b) by 0 days.

(21) Appl. No.: 17/012,910

(22) Filed: Sep. 4, 2020

(65) Prior Publication Data

US 2021/0092504 A1 Mar. 25, 2021

(51) Int. Cl.
*H04R 1/00* (2006.01)
*H04R 1/10* (2006.01)

(52) U.S. Cl.
CPC ..... *H04R 1/1016* (2013.01); *H04R 1/105* (2013.01)

(58) Field of Classification Search
CPC .... H04R 1/1016; H04R 1/105; H04R 1/1066; H04R 1/10; H04R 2420/07
See application file for complete search history.

(56) References Cited

U.S. PATENT DOCUMENTS

2011/0249855 A1 10/2011 Tamura et al.
2019/0200112 A1* 6/2019 Briggs ..... H04R 1/1066
2020/0344539 A1* 10/2020 Sandanger ..... H04R 25/652

FOREIGN PATENT DOCUMENTS

EP 3240298 A1 11/2017
JP 2016-119527 A 6/2016
JP 2017098877 A 6/2017
WO 2019125928 A1 6/2019

OTHER PUBLICATIONS

Extended European Search Report dated May 3, 2021 corresponding application No. 20196654.6-1210.

* cited by examiner

*Primary Examiner* — Matthew A Eason
(74) *Attorney, Agent, or Firm* — Nath, Goldberg & Meyer; Jerald L. Meyer

(57) ABSTRACT

An earphone includes a main body unit in which an outside shape of one edge portion is formed in an arc shape to be fitted into a pinna, a sound tube portion extending from the main body unit to a first surface side of the main body unit, and a supporter for covering at least the first surface side at a side of the one edge portion in the main body unit. The supporter includes a protruding portion protruded toward the first surface side in an arc shape corresponding to an arc shape of the outside shape of the one edge portion in the main body unit.

7 Claims, 7 Drawing Sheets

EARPHONE AND SUPPORTER THEREOF

CROSS REFERENCE TO RELATED APPLICATION

This application is based upon and claims the benefit of priority under 35 U.S.C. § 119 from Japanese Patent Application No. 2019-172816 filed on Sep. 24, 2019, the entire contents of which are incorporated herein by reference.

BACKGROUND

The present disclosure relates to an earphone and a supporter of such an earphone.

Japanese Unexamined Patent Application Publication No. 2016-119527 describes a canal type earphone including a main body unit with which an earpiece inserted in an ear canal is attached, and a protruding portion protruding from the main body unit so as to abut onto an inner wall of a pinna when in use.

SUMMARY

In such canal type earphone, it is desired that the ear canal should be closed with a high degree of sealing by the earpiece so that high sound insulation properties can be obtained during use. Such earpiece are generally formed with flexible materials, such as silicone rubber, in an umbrella shape, and are deformed along an entrance shape of the ear canal so as to close the ear canal with a relatively high degree of sealing.

However, since a shape of the entrance of the ear canal greatly varies between individuals, there is a limit to closing the ear canal by means of the earpiece with a high degree of sealing regardless of the individual difference. Moreover, in wireless earphone which have been popularized in recent years, a size of a main body unit has been increased and a drawing-out shape of a code cannot also be used for being fitted into the pinna. Accordingly, an idea for improving steadily the fitting into the pinna of the main body unit is required. If a fitting state into the pinna of the main body unit is unstable, a fitting state into the ear canal of the earpiece is also unstable, and therefore it is difficult to stably obtain high sound insulation properties.

A first aspect of one or more embodiments provides an earphone comprising: a main body unit in which an outside shape of one edge portion is formed in an arc shape to be fitted into a pinna; a sound tube portion extending from the main body unit to a first surface side of the main body unit; and a supporter for covering at least the first surface side at a side of the one edge portion in the main body unit, wherein the supporter includes a protruding portion protruded toward the first surface side in an arc shape corresponding to an arc shape of the outside shape of the one edge portion in the main body unit.

A second aspect of one or more embodiments provides an earphone comprising: a main body unit in which an outside shape of one edge portion is formed in an arc shape to be fitted into a pinna; a sound tube portion extending from the main body unit to a first surface side of the main body unit; a supporter covering at least the first surface side at a side of the one edge portion in the main body unit, and including a protruding portion protruded to the first surface side in an arc shape corresponding to an arc shape of an outside shape of the one edge portion in the main body unit; and an earpiece attached to the sound tube portion, wherein when the earpiece is inserted in inside the ear canal or is putted to an entrance edge portion of the ear canal, the one edge portion of the main body unit is coming into contact with a wide range in a peripheral direction in an inner wall of the antihelix.

A third aspect of one or more embodiments provides a supporter of an earphone, the supporter being attachable and detachable to/from the main body unit of the earphone, the earphone comprising: a main body unit in which an outside shape of one edge portion is formed in an arc shape to be fitted into a pinna; and a sound tube portion extending from the main body unit to a first surface side of the main body unit, wherein the supporter includes a protruding portion protruded toward the first surface side in an arc shape corresponding to an arc shape of the outside shape of the one edge portion in the main body unit, in a state of being fitted to the main body unit.

DETAILED DESCRIPTION

An earphone and a supporter of then earphone according to the embodiment will now be described with reference to an earphone 91 and a supporter 2.

Figure 1:
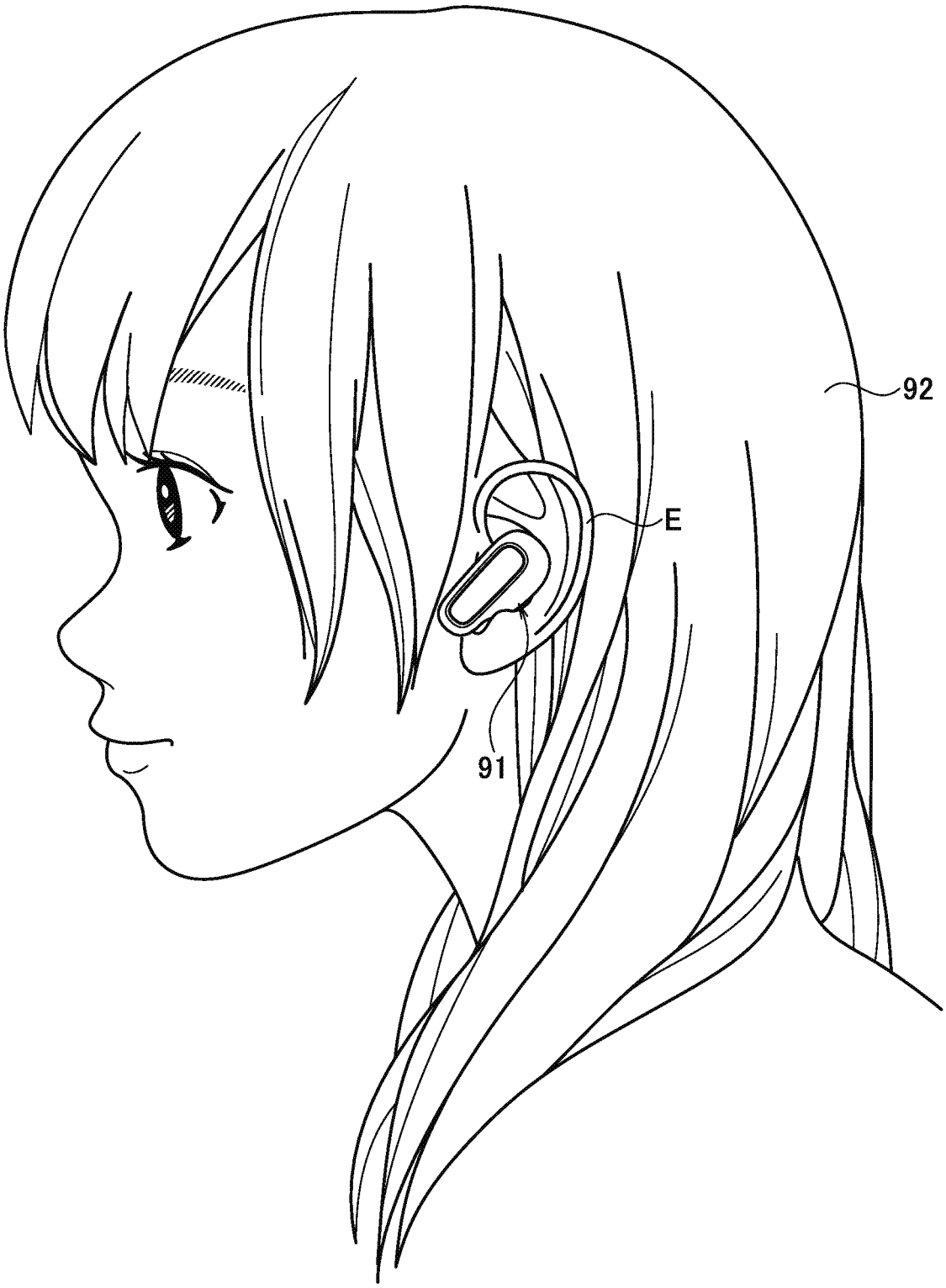
FIG. 1 is a diagram illustrating a state in which an earphone 91, which is an earphone according to the embodiment, is fitted into a left ear.

FIG. 1 is a diagram of a left side head illustrating a state where the earphone 91 is fitted into a left pinna E of a user 92. The earphone 91 is a canal type wireless earphone, which is used for left ear to be fitted into the pinna E, in which no cord to be connected to an external device is drawn out. An earphone 91 for the right ear has the same configuration formed symmetrically with respect to the earphone for the left ear. Hereinafter, the earphone 91 for the left ear will now be described.

Figure 2:
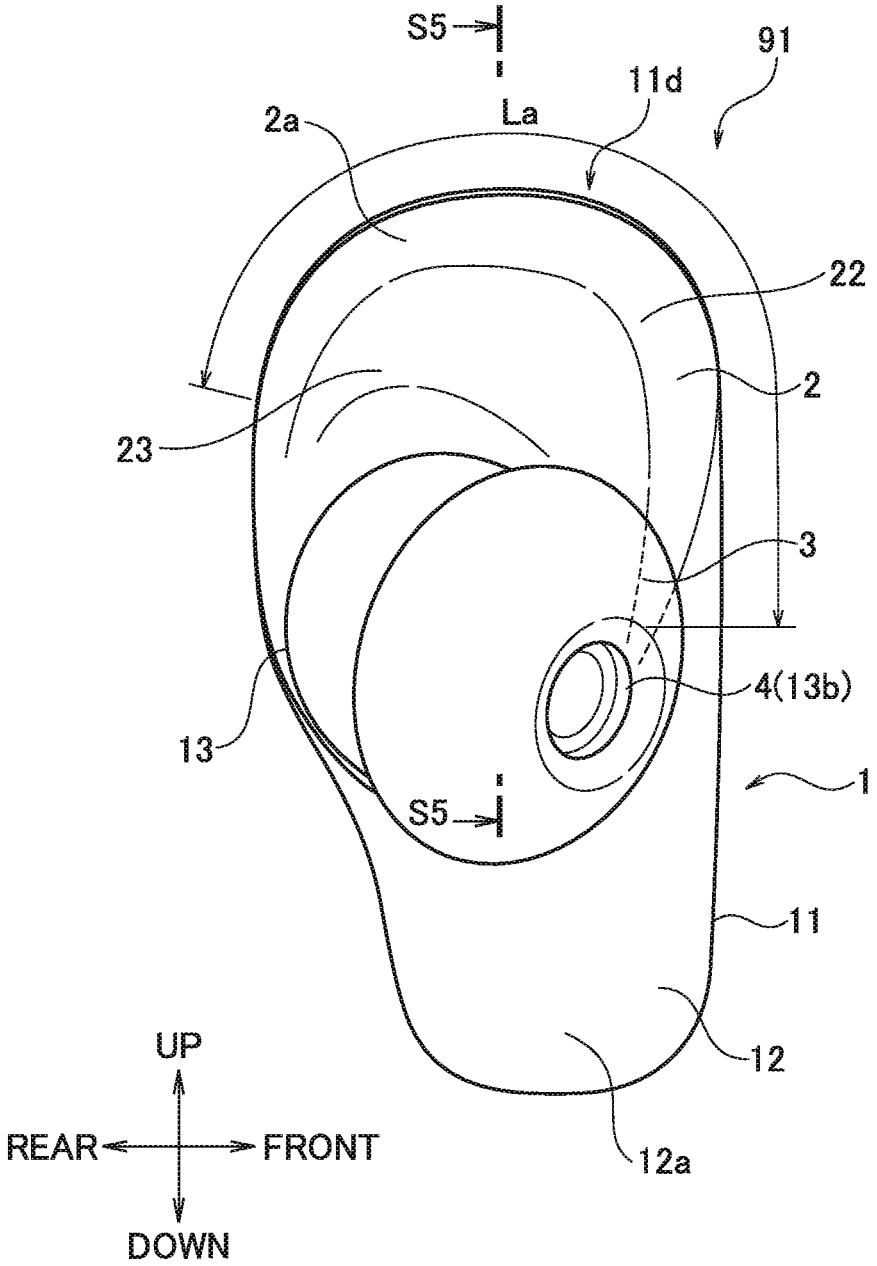
FIG. 2 is a right side view of the earphone 91.
Figure 3:
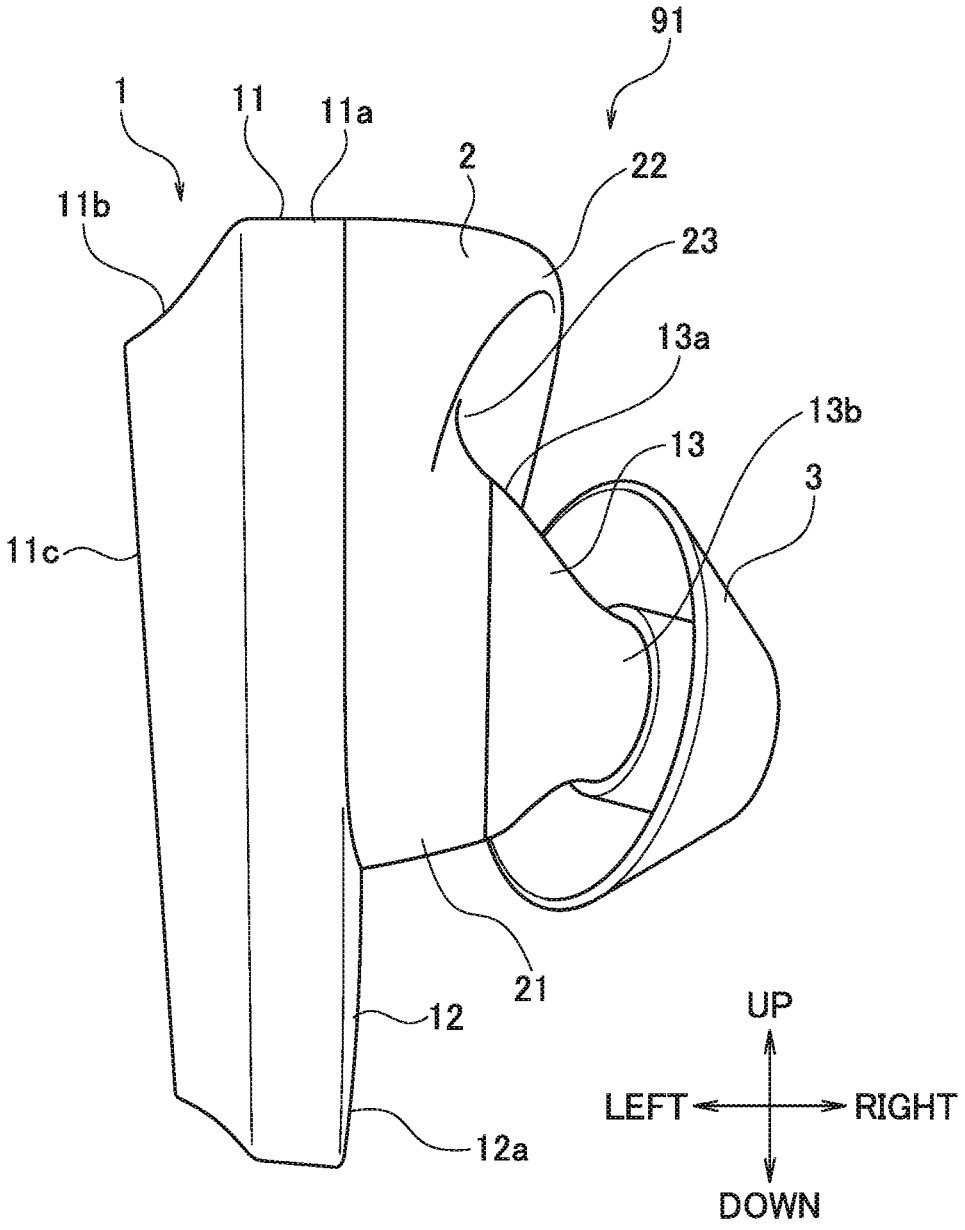
FIG. 3 is a rear view of the earphone 91.

FIG. 2 is a right side view of the earphone 91 and FIG. 3 is a rear view thereof. Here, the up, down, front, and rear, directions are defined by the arrows in FIG. 2, and the up, down, left, and right directions are defined by the arrows in FIG. 3. In FIG. 2, the right side corresponds to the front side of the drawing sheet, and the left side corresponds to the rear side of the drawing sheet.

As illustrated in FIGS. 2 and 3, the earphone 91 includes a main body unit 1, a supporter 2, and an earpiece 3. The main body unit 1 is formed to be long in the up-and-down direction and to be thin in the right-left direction, and houses an electronic circuit for wireless transmission and reception, a battery, and a speaker unit (each is not illustrated) therein.

Figure 5:
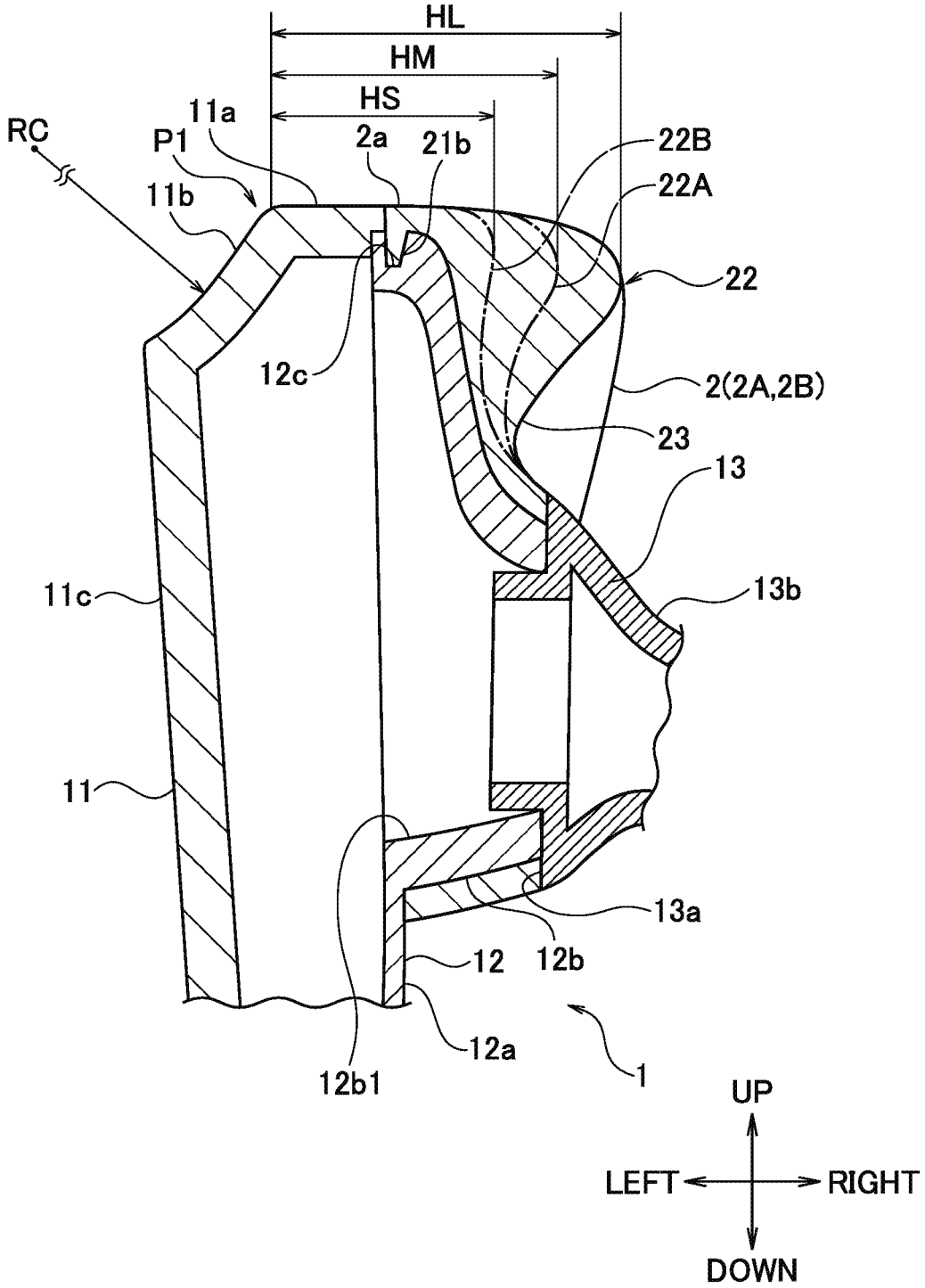
FIG. 5 is a partial longitudinal sectional view of the earphone 91.

FIG. 5 is a schematic partial sectional view taken in the line S5-S5 of FIG. 2. As illustrated in FIGS. 2, 3, and 5, the main body unit 1 includes a base 11, a top panel 12, and a cap 13.

The base 11 is formed to be thin box-like in the right-left direction, in which the left side is a bottom and the right side is released. The base 11 includes a body portion 11*a*, an inclined portion 11*b*, and a bottom 11*c*, from the right side. The body portion 11*a* is formed as a peripheral wall for forming approximately the maximum outside shape of the main body unit 1. The inclined portion 11*b* is formed as a portion having an inclined surface in a chamfered shape that is connected to a left edge of the body portion 11*a* and is inclined so that the outside shape decreases toward the left. The bottom 11*c* is formed in a flat plate shape connected to the left edge portion of the inclined portion 11*b* and extending in the up, down, front, and rear, directions. More specifically, the inclined portion 11*b* is provided in a ridge line portion between the body portion 11*a* and the bottom 11*c*. In this example, the inclined portion 11*b* is formed as a reverse R-shaped concave surface in which a center portion is concaved (the center of curvature RC is outside the base 11), as illustrated in FIG. 5.

The top panel 12 is a member which closes the opened right side of the base 11 and extends approximately in the up, down, front, and rear, directions. Hereinafter, the right surface side of the base 11 is referred to as a first surface side and the opposite left surface side is referred to as a second surface side. The top panel 12 includes a flat plate portion 12*a* having a plate shape, and a protruding portion 12*b* (FIG. 5) formed at a center portion of the flat plate portion 12*a* and gently rising in the right direction. An opening 12*b*1 (FIG. 5) to which the cap 13 is engaged is formed at the protruding portion 12*b*.

The cap 13 is formed in a funnel shape as illustrated in FIGS. 3 and 5. As illustrated in FIG. 5, the cap 13 has a left large-diameter side having an overhung flange 13*a* engaged with the opening 12*b*1 of the top panel 12, and a small-diameter side having a cylindrical sound tube portion 13*b* extending obliquely right front downward. A sound output hole 4 (FIG. 2) is opened in outer space at a tip surface of the sound tube portion 13*b*. An earpiece 3 is detachably attached to the tip part of the sound tube portion 13*b*.

In the earphone 91, the electronic circuit for the wireless transmission and reception housed in the inside of the main body unit 1 wirelessly obtains a sound signal from the outside and outputs the obtained sound signal as sound from the speaker unit. The sound output from the speaker unit is emitted to the outer space from the sound output hole 4 through the internal space of the sound tube portion 13*b*.

Figure 4:
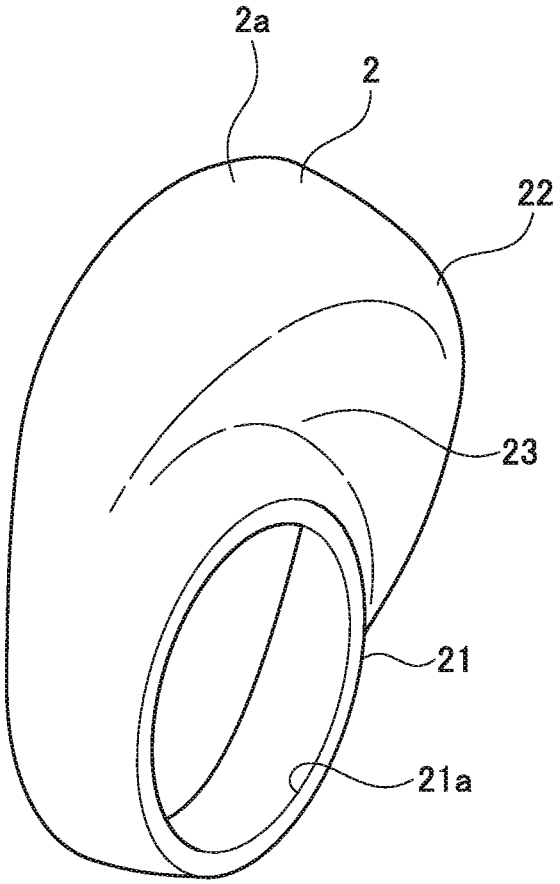
FIG. 4 is a perspective view illustrating a supporter 2 of the earphone 91.

FIG. 4 is a perspective view for illustrating the supporter 2. The supporter 2 includes a base portion 21 and a protruding portion 22, and is formed with flexibility materials such as silicone rubber so as to be attachable and detachable to/from the main body unit 1. The base portion 21 includes a through hole 21*a* and can be fitted between the top panel 12 and the flange 13*a* of the cap 13, as illustrated in FIGS. 3 and 5. Moreover, the base portion 21 includes a cover portion 23 for covering an upper right surface of the top panel 12. The protruding portion 22 is formed to be protruded in an arc shape at the right side within a range La illustrated in FIG. 2, along the shape of the upper edge of the base portion 21. The right side is a direction approaching the temporal region of head of the user 92 when the earphone 91 is used. The contour shape of the upper edge portion 2*a* of the supporter 2 is matched to the shape of an upper-side edge portion 11*d* which is an upper edge as one edge portion of the base 11 in the main body unit 1.

As illustrated in FIG. 5, an inner flange 21*b* protruded inside is formed in an arc shape at an upper edge portion 2*a* of the supporter 2, and a groove portion 12*c* which is inside concave is formed in an arc shape corresponding to the inner flange 21*b* at an upper edge portion of the top panel 12. The user 92 can manually attach the supporter 2 to the main body unit 1 by elastically deforming the supporter 2 to fit the base portion 21 between the flange 13*a* and the top panel 12 and engaging the inner flange 21*b* with the groove portion 12*c*. Conversely, user 92 can manually remove the supporter 2 from main body unit 1 by elastically deforming the supporter 2.

As illustrated in FIG. 5 by the broken chain lines, a plurality of types of exchangeable supporters 2, each having a protruding portion 22 corresponding to the height of antihelix Eb used for an index of the size of the pinna E, are provided for the earphone 91. In this example, there are three types of a large-sized supporter 2 (size L), a medium-sized supporter 2A (size M), and a small-sized supporter 2B (size S), from the larger one.

As illustrated in FIG. 5, the supporters 2, 2A, and 2B respectively have protruding portions 22, 22A, and 22B respectively having different heights to be protruded to the first surface side of the base 11 from the reference position P1 which is a boundary position between the body portion 11*a* and the inclined portion 11*b* in the base 11. The heights of the protruding portions 22, 22A, and 22B from the reference position P1 is respectively height HL, height HM, and height HS.

Figure 6A:
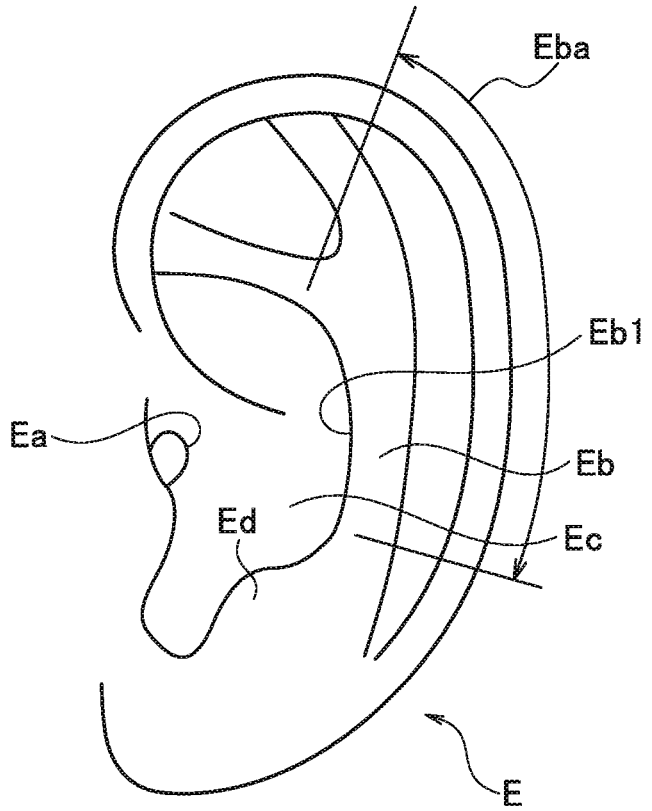
FIG. 6A is a diagram illustrating a left pinna.
Figure 6B:
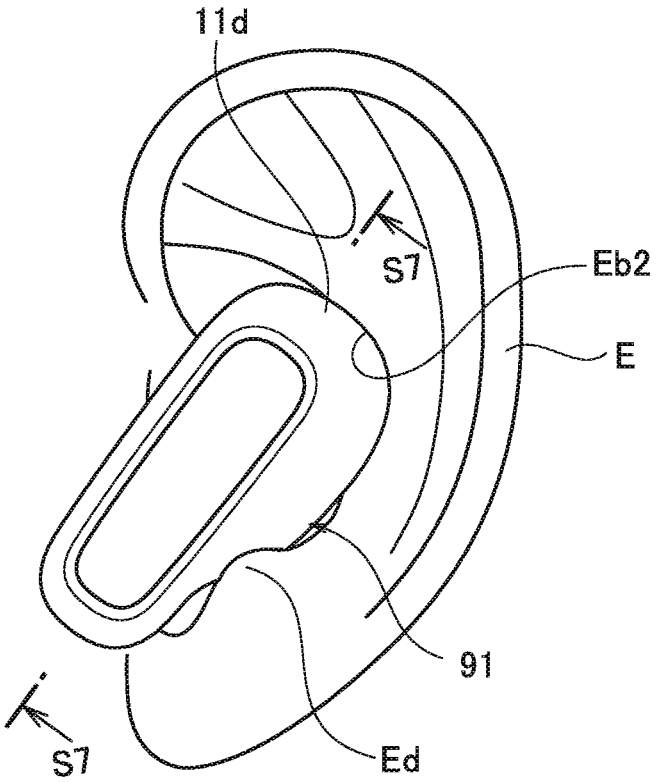
FIG. 6B is a left side view illustrating a state where the earphone 91 is fitted to the pinna E illustrated in FIG. 6A.
Figure 7A:
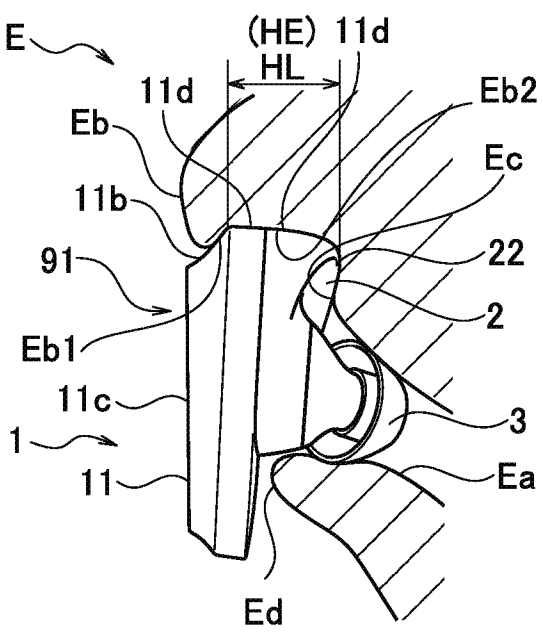
FIG. 7A is a sectional view schematically illustrating a state where the earphone 91 is fitted into the pinna E, to illustrate a case where the supporter 2 is fitted to a main body unit 1.
Figure 7B:
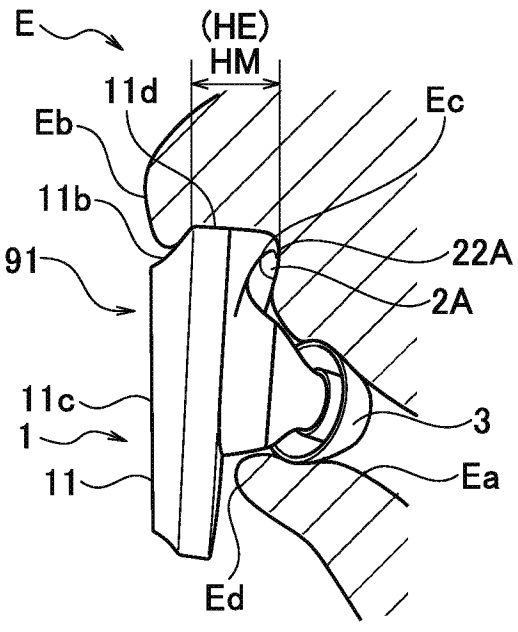
FIG. 7B is a sectional view schematically illustrating a state where the earphone 91 is fitted into the pinna E, to illustrate a case where the supporter 2A is fitted to a main body unit 1.
Figure 7C:
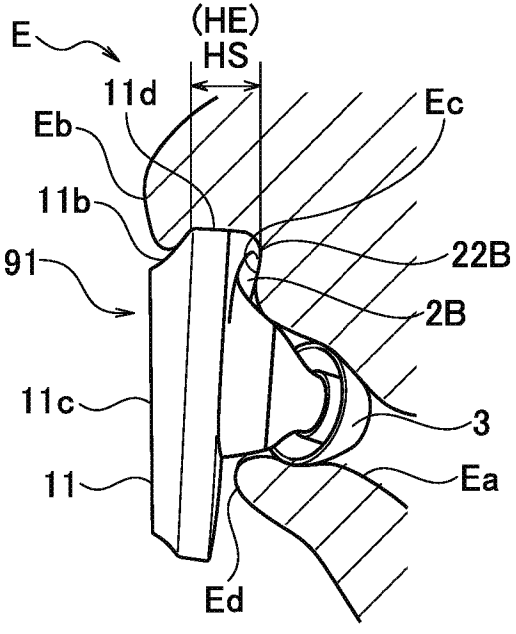
FIG. 7C is a sectional view schematically illustrating a state where the earphone 91 is fitted into the pinna E, to illustrate a case where the supporter 2B is fitted to a main body unit 1.

The state where earphone 91 is fitted into the pinna E (hereinafter, referred to as a fitting state) will now be described with reference to FIGS. 6 and 7. FIG. 6A is a diagram for explaining the left pinna E, and FIG. 6B illustrates the fitting state of the earphone 91 with respect to the pinna E shown in FIG. 6A. FIG. 7 is a sectional view taken in the position S7-S7 of FIG. 6B, and the diagrams of FIGS. 7A, 7B, and 7C respectively corresponds to the case of size L, the case of size M, and the case of size S of the supporter 2.

In FIG. 6A, the pinna E includes the ear canal Ea, the antihelix Eb, the concha auriculae Ec, and antitragus Ed. The antihelix Eb generally rises from the concha auriculae Ec as an arc-shaped wall surrounding the ear canal Ea. As illustrated in FIG. 7, the antihelix Eb is a projection portion Eb1 where a tip portion protrudes inside. As illustrated in FIGS. 6B and 7A, a shape of the upper-side edge portion 11*d* which is a peripheral portion of the upper portion of the main body unit 1 in the earphone 91 is formed in an approximately arc shape corresponding to the shape of the inner wall Eb2 of the antihelix Eb. Moreover, the protruding portion 22 of the supporter 2 attached to the main body unit 1 is protruded in an arc shape along the shape of the upper-side edge portion 11*d* of the main body unit 1.

At the time when the supporter 2 is attached to the main body unit 1 and the earphone 91 is fitted into the pinna E by the user 92, when the earpiece 3 is inserted in inside the ear canal Ea or is putted to an entrance edge portion of the ear canal Ea, the upper-side edge portion 11*d* of the main body unit 1 is coming into contact with a wide range in a peripheral direction and a height direction in the inner wall Eb2 of the antihelix Eb, as illustrated in FIG. 7A. The wide range of the inner wall Eb2 with where the main body unit 1 is coming into contact is illustrated in FIG. 6A as the range Eba of the arc range in the peripheral direction.

In this state, the upper portion of the supporter 2 and the main body unit 1 is fitted into the range of the height HE between the base near portion of the antihelix Eb in the concha auriculae Ec and the projection portion Eb1 of the antihelix Eb. Moreover, the projection portion Eb1 is hooked on the inclined portion 11*b* in the base 11 of the main body unit 1. Consequently, the upper-side edge portion 11*d* of the earphone 91 is held inside the antihelix Eb. Therefore, the earphone 91 is fitted into the pinna E by a plurality of engagement of the engagement between the earpiece 3 and the ear canal Ea and the engagement between the upper-side edge portion 11*d* and the antihelix Eb. Accordingly, since the earphone 91 is stably fitted into the pinna E and the earpiece 3 is also stably fitted into the ear canal Ea, the user 92 can listen to a reproduced sound, while steadily obtaining high sound insulation properties with the earphone 91.

Moreover, in the earphone 91, a cover portion 23 of the supporter 2 covers an upper right surface of the top panel 12. Therefore, since the cover portion 23 is contacted with the concha auriculae Ec so as to be softly substantially adhered thereto in a state where the earphone 91 is fitted into the pinna E, an outside noise to reach the ear canal Ea through the concha auriculae Ec can be interrupted. Consequently, the sound insulation is further improved, and the outside noise affecting the sound heard by the user 92 can be reduced.

The height HE of the inner wall Eb2 of the antihelix Eb illustrated in FIG. 7A has a large individual difference. Therefore, a plurality of types of the supporter 2 having different heights of the protruding portion 22 are prepared for earphone 91 in advance, as described above, and the user 92 can select the supporter 2, which is adapted to the height of the antihelix Eb in the own pinna E, to be attached to the main body unit 1.

For example, FIG. 7B illustrates a state where a supporter 2A having a protruding portion 22A lower than the protruding portion 22 is attached to the main body unit 1 and the earphone 91 is fitted into the pinna E, when the height HE of the inner wall Eb2 of the antihelix Eb is lower than that in FIG. 7A. Moreover, FIG. 7C illustrates a state where a supporter 2B having a protruding portion 22B lower than the protruding portion 22A is attached to the main body unit 1 and the earphone 91 is fitted into the pinna E, when the height HE of the inner wall Eb2 of the antihelix Eb is lower than that in FIG. 7B.

The tip of each protruding portion 22, 22A, and 22B of the supporters 2, 2A, and 2B is coming into contact with the concha auriculae Ec, and the projection portion Eb1 is hooked on the inclined portion 11*b*, and thereby the earphone 91 can be satisfactory and steadily fitted into the pinna E regardless of the individual differences of the shape of the antihelix Eb. The protruding portions 22, 22A, and 22B of the supporter 2 are soft and elastic. Therefore, the earphone 91 can be fitted into the pinna E more satisfactory by selecting the supporter having the protruding portion higher than the height HE of the inner wall Eb2.

The examples described above in detail are not limited to aforementioned configurations and may be modified as modified examples within a scope not departing from the spirit of the present invention.

In FIG. 5, although the protruding portion 22 of the supporter 2 not having an air gap in the inside thereof has been described, it may be formed so as to have an air gap inside thereof. The example in which the inclined portion 11*b* is formed as the reverse R-shaped curved surface in which the center portion is concave inward has been described, but the present invention is not limited thereto. The inclined portion 11*b* may be a surface which is a straight line in the longitudinal section of FIG. 5, or may be formed as a positive R-shaped curved surface of which the center portion is protruded outward. When the inclined portion 11*b* is formed in the reverse R-shaped curved surface, the projection portion Eb1 of the antihelix Eb is hooked thereon so as to be further engaged. Therefore, it is a preferable shape when the user wants to obtain a stronger fitting feeling. The earphone 91 may not be limited to a wireless earphone but may be a wired earphone. The supporters 2, 2A, and 2B may not be limited to attachable and detachable supporters to/from the main body unit 1, but may be formed so as to be integrated with the main body unit 1.

According to the present embodiment, there are provided the earphone and the supporter of the earphone from which high sound insulation properties can be stably obtained.

What is claimed is:

1. An earphone comprising:

a main body unit in which an outside shape of one edge portion is formed in an arc shape to be fitted into a pinna;

a sound tube portion extending from the main body unit to a first surface side of the main body unit; and a supporter for covering at least the first surface side at a side of the one edge portion in the main body unit, wherein the supporter includes a protruding portion that has an arc shape matched to an arc shape of the outside shape of the one edge portion in the main body unit and that protrudes toward the first surface side in accordance with the height of the antihelix of a pinna, and wherein, when fitted into the pinna, the one edge portion is the main body unit comes into contact with an arc range in a peripheral direction in the inner wall of the antihelix, and the supporter contacts the concha auriculae of the pinna so as to substantially adhere.

2. The earphone according to claim 1, further comprising an inclined portion having an inclined surface in a chamfered shape in a ridgeline of a second surface side opposite to the first surface side in the one edge portion.

3. The earphone according to claim 2, wherein the inclined surface is formed as a concave surface.

4. An earphone comprising:

a main body unit in which an outside shape of one edge portion is formed in an arc shape to be fitted into a pinna;

a sound tube portion extending from the main body unit to a first surface side of the main body unit;

a supporter covering at least the first surface side at a side of the one edge portion in the main body unit, and including a protruding portion that has an arc shape matched to an arc shape of an outside shape of the one edge portion in the main body unit and that protrudes toward the first surface side in accordance with the height of the antihelix of a pinna; and an earpiece attached to the sound tube portion, wherein, when the earpiece is inserted in inside an ear canal or is putted to an entrance edge portion of the ear canal, the one edge portion of the main body unit is coming into contact with an arc range in a peripheral direction in an inner wall of an antihelix, and the supporter contacts the concha auriculae of the pinna so as to substantially adhere.

5. The earphone according to claim 4, further comprising an inclined portion having an inclined surface in a chamfered shape in a ridgeline of a second surface side opposite to the first surface side in the one edge portion, wherein when a tip of the protruding portion of the supporter is coming into contact with a concha auriculae of the pinna, a tip portion of the antihelix is hooked on the inclined portion.

6. The earphone according to claim 1, wherein the supporter is attachable and detachable to/from the main body unit.

7. A supporter of an earphone, the earphone comprising a main body unit in which an outside shape of one edge portion is formed in an arc shape to be fitted into a pinna and a sound tube portion extending from the main body unit to a first surface side of the main body unit, the supporter being attachable and detachable to/from the main body unit of the earphone, the supporter of the earphone comprising:

a protruding portion that has an arc shape matched to an arc shape of the outside shape of the one edge portion in the main body unit, in a state of being fitted to the main body unit and that protrudes toward the first surface side in accordance with the height of the antihelix of a pinna.

* * * * *